US006014875A

United States Patent [19]

Lonati et al.

[11] Patent Number: 6,014,875

[45] Date of Patent: Jan. 18, 2000

[54] NEEDLE SELECTION DEVICE, PARTICULARLY FOR SELECTING THE DIAL NEEDLES IN CIRCULAR KNITTING MACHINES

[75] Inventors: Francesco Lonati; Ettore Lonati; Fausto Lonati; Tiberio Lonati, all of Brescia, Italy

[73] Assignee: Santoni S.p.A., Brescia, Italy

[21] Appl. No.: 09/123,393

[22] Filed: Jul. 15, 1998

[51] Int. Cl.[7] ..... D04B 9/00

[52] U.S. Cl. ..... 66/220; 66/123

[58] Field of Search ..... 66/15, 216, 217, 66/218, 219, 220, 221, 123, 116, 19, 20

[56] References Cited

U.S. PATENT DOCUMENTS

| | | | |
|---|---|---|---|
| 3,550,398 | 12/1970 | Widdowson | 66/221 |
| 3,709,004 | 1/1973 | Paepke | 66/219 |
| 4,570,463 | 2/1986 | Otto | 66/221 |
| 4,715,198 | 12/1987 | Ploppa et al. | 66/219 |

FOREIGN PATENT DOCUMENTS

| | | | |
|---|---|---|---|
| 3712673 | 8/1988 | Germany | 66/219 |

*Primary Examiner*—John J. Calvert
*Assistant Examiner*—Larry D. Worrell, Jr.
*Attorney, Agent, or Firm*—Guido Modiano; Albert Josif; Daniel J. O'Byrne

[57] ABSTRACT

A needle selection device in a circular knitting machine, including: needles which are slidingly accommodated in grooves formed in a needle holder and which have pivoting levers provided with heels; needle actuation cams facing the needle holder and forming a path which can be engaged by the heels of the needle levers as the needle holder moves with respect to the needle actuation cams in order to make the levers follow the path for actuation of the corresponding needle along the corresponding groove of the needle holder parallel to the longitudinal extension of the needle, and for each needle the lever oscillates about its pivoting axis, from an active position, in which its heel protrudes from the corresponding groove of the needle holder so as to engage the path formed by the needle actuation cams, to an inactive position, in which its heel is inserted in the corresponding groove of the needle holder in order to avoid engaging the path formed by the needle actuation cams; a reset element acting on the lever of each needle to move it from the active position to the inactive position; an electromagnetic device facing a ferromagnetic portion of the lever for each needle and actuated on command to keep the lever in the inactive position or to move it into the active position.

6 Claims, 2 Drawing Sheets

NEEDLE SELECTION DEVICE, PARTICULARLY FOR SELECTING THE DIAL NEEDLES IN CIRCULAR KNITTING MACHINES

BACKGROUND OF THE INVENTION

The present invention relates to a needle selection device, particularly for selecting the dial needles in circular machines for knitting, hosiery or the like.

Various devices are known, in the field of machines for knitting or hosiery, for performing needle selection, i.e., to actuate specific needles with respect to other needles which are kept inactive in order to perform particular patterns.

Conventional selection devices entail the problem that they are relatively bulky, making it difficult to apply them in small-diameter circular machines, particularly if the selection device must actuate the needles of the dial of single-cylinder dial-and-cylinder circular machines.

SUMMARY OF THE INVENTION

The aim of the present invention is to solve the above problem by providing a needle selection device, particularly for selecting the dial needles in circular machines for knitting, hosiery or the like, which can be extremely compact and can be easily installed also in small-diameter circular machines.

Within the scope of this aim, an object of the present invention is to provide a device which is particularly suitable for selecting dial needles in dial-and-cylinder circular machines.

Another object of the present invention is to provide a needle selection device which is highly reliable in operation.

This aim, these objects and others which will become apparent hereinafter are achieved by a needle selection device, particularly for selecting the dial needles in circular machines for knitting, hosiery or the like, characterized in that it comprises needles which are slidingly accommodated in grooves formed in a needle holder and are provided, at their longitudinal end that is furthest from the tip, with a lever which is pivoted to the needle about a pivoting axis which is substantially perpendicular to a plane of arrangement of lateral faces of the needle, said lever being provided with at least one heel that protrudes transversely from the side of the lever that is furthest from the bottom of the corresponding groove of the needle holder; needle actuation cams being provided which face said needle holder and form at least one path which can be engaged by said heel of the lever, said needle holder being able to move with respect to said needle actuation cams in order to make said levers follow said at least one path for the actuation of the corresponding needle along the corresponding groove of the needle holder parallel to the longitudinal extension of the needle; said lever being able to oscillate, about said pivoting axis, from an active position, in which its heel protrudes from the corresponding groove of the needle holder so as to engage the path formed by said needle actuation cams, to an inactive position, in which its heel is inserted in the corresponding groove of the needle holder in order to avoid engaging said path formed by said needle actuation cams; a reset element being provided which acts on said lever to move it from said active position to said inactive position; electromagnetic means being further provided which face a ferromagnetic portion of said lever and can be actuated on command to keep said lever in said inactive position or to move it into said active position.

BRIEF DESCRIPTION OF THE DRAWINGS

Further characteristics and advantages of the present invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
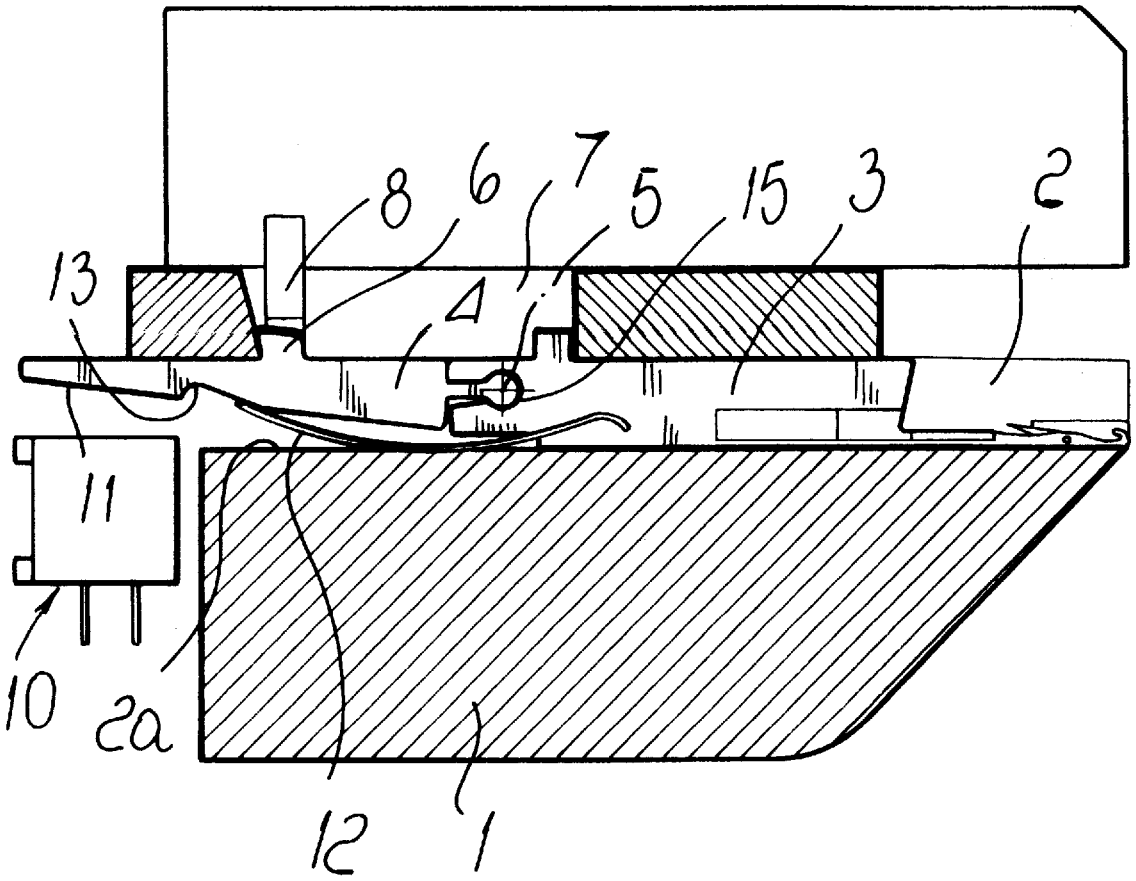
FIG. 1 is a schematic view of the device according to the invention, applied to the dial of a dial-and-cylinder circular machine, which is shown only partially in a radial cross-section, with the lever of the selection device in the active position.
Figure 2:
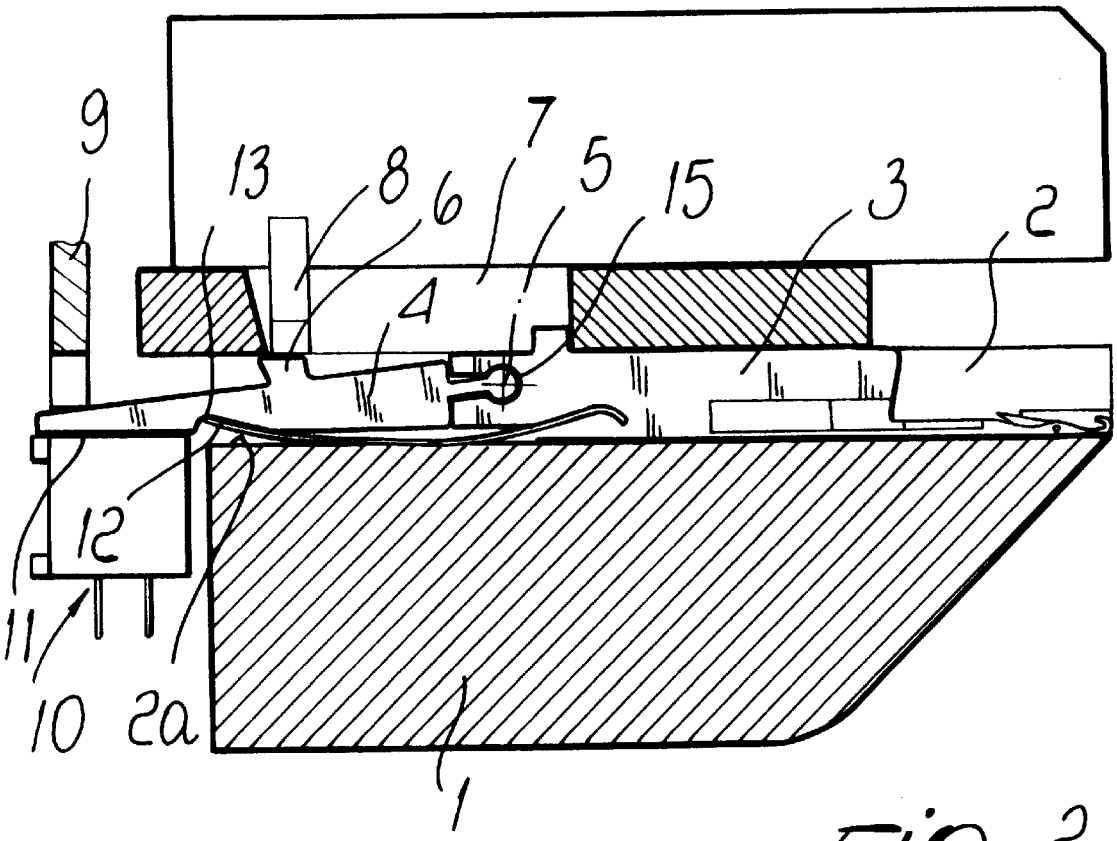
FIG. 2 is a view, similar to FIG. 1, of the selection device according to the invention with the lever of the device in the inactive position.

With reference to the above figures, the needle selection device according to the invention is described with particular reference to its application to the dial of a dial-and-cylinder circular machine.

The dial, designated by the reference numeral 1, has a plurality of radial grooves 2 inside each whereof a needle 3 is slidingly accommodated.

Each needle has, at its longitudinal end that lies furthest from the point, a lever 4 which is pivoted to the needle 3 about a pivoting axis 5 which is substantially perpendicular to the plane of arrangement of the two lateral faces of the needle 3.

In practice, the lever 4 can oscillate about the axis 5 on a plane which is perpendicular to the bottom 2*a* of the groove 2 of the needle holder, which is constituted by the dial 1 in the illustrated embodiment.

The lever 4 has at least one heel 6 which protrudes transversely from the side of the lever 4 that is furthest from the bottom of the corresponding groove 2 of the dial 1. The dial 1 is faced by needle actuation cams 7, which form at least one path 8 in which the heel 6 of the lever 4 can engage. The path is shaped so as to produce, as a consequence of the actuation of the dial 1 with a rotary motion about its axis with respect to the cams 7, a movement of the needle 3 parallel to its own longitudinal extension inside the corresponding groove 2 of the dial 1.

More particularly, the lever 4 can oscillate about its own pivoting axis 5 with respect to the needle 3 in order to pass from an active position, in which its heel 6 protrudes from the corresponding groove 2 of the dial 1 so as to engage the path 8 formed by the cams 7, to an inactive position, in which its heel 6 is inserted in the corresponding groove 2 of the dial 1 so as to avoid engaging the path 8 formed by the cams 7.

The selection device comprises a reset element 9, which acts on the lever 4 to move it from the active position to the inactive position, and electromagnetic means 10 which face a ferromagnetic portion 11 of the lever 4 and can be actuated on command in order to keep the lever 4 in the inactive position or move it into the active position.

It should be noted that the lever 4 can be made monolithically of ferromagnetic material or only its portion 11, which faces the electromagnetic means 10, can be sensitive to magnetic attraction.

The movement of the lever 4 in passing from its active position to the inactive position is contrasted by elastic means, which are conveniently constituted by a leaf spring 12 in which one end is fixed to the needle 3 and the other end rests inside a recess 13 specifically provided on the side of the lever 4 that is directed towards the bottom 2*a* of the groove 2.

The pivoting of the lever 4 to the needle 3 is achieved by giving a pivot-like shape to the end of the lever 4 that is meant to couple to the needle 3 and by inserting it in a cylindrical seat 15 formed in the longitudinal end of the needle 3 that is furthest from the tip.

Figure 3:
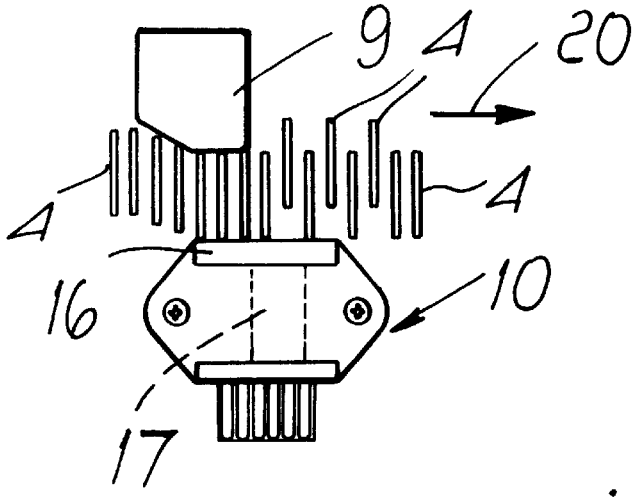
FIG. 3 is a schematic view of the levers of the selection device, seen from the axis of the dial, schematically illustrating the reset element and the electromagnetic means.

The reset element 9 is constituted by a reset cam, which is rigidly coupled to the cams 7 in the movement of the dial 1 and is arranged upstream of the electromagnetic means 10 in the direction of the movement of the dial 1 with respect to the cams 7, to the reset cam 9, and to the electromagnetic means 10, designated by the arrow 20 in FIG. 3.

The electromagnetic means 10 comprise a permanent magnet 16 and at least one electromagnet 17 which is arranged at said permanent magnet 16 and can be actuated so as to substantially cancel out the effect of the permanent magnet 16 on the lever 4.

Operation of the selection device according to the invention is as follows.

During the rotation of the dial 1 about its axis, when the selection levers 4, in the active position, engage the reset cam 9 they are moved into the inactive position, resting on the permanent magnet 16, which keeps them in the inactive position, as shown in particular in FIG. 3.

If the levers 4 are to be kept in the inactive position, the electromagnet 17 is not activated. As a consequence of this fact, the lever 4 remains in the inactive position and cannot engage, by means of its heel 6, in the path 8 formed by the cams 7. In this manner the needles 3 that correspond to the levers 4 kept in the inactive position are not actuated. Once the permanent magnet 16 has ended, the levers 4 could be pushed by the corresponding leaf spring 12 into the active position; however, their transfer into the active position is contrasted by the presence of the cams 7, since the path 8 is shaped so that it can be engaged by the heels 6 of the levers 4 only in the region located at the above-described electromagnetic means 10.

If instead the needles 3 must be actuated, then the electromagnet 17 is actuated and, by canceling out the effect of the permanent magnet 16, allows the lever 4 to oscillate about the axis 15 from the inactive position to the active position. Accordingly, the heel 6 of the lever 4 engages in the path 8 formed by the cams 7 and therefore the corresponding needle 3 is actuated.

It should be noted that the reset cam 9, the permanent magnet 16 and the electromagnet 17 can be given such dimensions as to allow needle-by-needle selection, i.e., so as to allow a selection which is different for each needle.

In practice it has been observed that the device according to the invention fully achieves the intended aim and objects, since it can be highly compact, so that it can be applied without problems also to the dial of small-diameter circular machines.

Although the present invention has been conceived particularly for small-diameter circular machines, it can nonetheless also be applied to large-diameter circular machines without thereby abandoning the scope of the protection of the present invention.

The device thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

The disclosures in Italian Patent Application No. MI97A01783 from which this application claims priority are incorporated herein by reference.

What is claimed is:

1. A combination of a needle selection device in a circular knitting machine, comprising:

needles which are slidingly accommodated in grooves formed in a needle holder and each of which is provided with a pair of lateral faces and a ferromagnetic portion and, at a respective longitudinal end that is furthest from a respective tip, with a respective lever which is pivoted to the respective needle about a pivoting axis which is substantially perpendicular to a plane of arrangement of the lateral faces of the respective needle, said lever being provided with at least one heel which protrudes transversely from one side of the lever;

needle actuation cams which face said needle holder and form at least one path which can be engaged by said heel of the lever of each of the needles, said needle holder being movable with respect to said needle actuation cams in order to make said levers follow said at least one path for an actuation of the corresponding needle along the corresponding groove of the needle holder parallel to a longitudinal extension of the needle, and for each needle said lever being able to oscillate, about said pivoting axis, from an active position, in which said heel protrudes from the corresponding groove of the needle holder so as to engage the path formed by said needle actuation cams, to an inactive position, in which said heel is inserted in the corresponding groove of the needle holder in order to avoid engaging said path formed by said needle actuation cams;

a reset element which acts on said lever of each needle to move said lever from said active position to said inactive position;

electromagnetic means which face said ferromagnetic portion of said lever for each needle and which can be actuated on command to keep said lever in said inactive position or to move said lever into said active position.

2. The combination of claim 1, further comprising elastic means which bias said lever for each needle from said active position towards said inactive position.

3. The combination of claim 2, wherein said elastic means comprise for each needle a leaf spring having a first end and a second end, said first end being connected to the needle and said second end acting on said lever.

4. The combination of claim 1, wherein said electromagnetic means comprise an electromagnet and a permanent magnet, said permanent magnet retaining said lever in said inactive position after an intervention of said reset element and said electromagnet being actuatable so as to substantially cancel out a magnetic effect of said permanent magnet on said lever.

5. The combination of claim 1, wherein said reset element is constituted by a reset cam which is rigidly coupled to said needle actuation cams in moving with respect to said needle holder, said reset cam being arranged upstream of said electromagnetic means with respect to a direction of movement of said needle holder with respect to said cams and said electromagnetic means.

6. The combination of claim 1, wherein said needle holder is constituted by a dial of a dial-and-cylinder circular knitting machine.

* * * * *

UNITED STATES PATENT AND TRADEMARK OFFICE

CERTIFICATE OF CORRECTION

PATENT NO. : 6,014,875
DATED : January 18, 2000
INVENTOR(S) : Francesco Lonati; Ettore Lonati; Fausto Lonati; Tiberio Lonati It is certified that error appears in the above-identified patent and that said Letters Patent is hereby corrected as shown below:

Title page,
Insert the following: [30] Foreign Application Priority Data
July 25, 1997 [IT] Italy ..... MI97A01783

Signed and Sealed this

Second Day of October, 2001

*Attest:*

Nicholas P. Godici

NICHOLAS P. GODICI
*Acting Director of the United States Patent and Trademark Office*

*Attesting Officer*